US010971807B2

(12) United States Patent
Tseng et al.

(10) Patent No.: US 10,971,807 B2
(45) Date of Patent: Apr. 6, 2021

(54) MOBILE DEVICE

(71) Applicant: Quanta Computer Inc., Taoyuan (TW)

(72) Inventors: Yi-Ling Tseng, Taoyuan (TW); Chung-Hung Lo, Taoyuan (TW); Chin-Lung Tsai, Taoyuan (TW); Ching-Hai Chiang, Taoyuan (TW); Kuan-Hsien Lee, Taoyuan (TW); Ying-Cong Deng, Taoyuan (TW); Chung-Ting Hung, Taoyuan (TW)

(73) Assignee: QUANTA COMPUTER INC., Taoyuan (TW)

( * ) Notice: Subject to any disclaimer, the term of this patent is extended or adjusted under 35 U.S.C. 154(b) by 0 days.

(21) Appl. No.: 16/550,755

(22) Filed: Aug. 26, 2019

(65) Prior Publication Data

US 2020/0295445 A1 Sep. 17, 2020

(30) Foreign Application Priority Data

Mar. 15, 2019 (TW) ..... 10810875.5

(51) Int. Cl.
*H01Q 1/36* (2006.01)
*H01Q 5/30* (2015.01)
(Continued)

(52) U.S. Cl.
CPC ..... *H01Q 1/36* (2013.01); *H01Q 1/2283* (2013.01); *H01Q 9/285* (2013.01)

(58) Field of Classification Search
CPC ..... H01Q 1/24; H01Q 1/241; H01Q 1/243; H01Q 1/36; H01Q 1/2283; H01Q 5/30; H01Q 13/10; H01Q 13/106
See application file for complete search history.

(56) References Cited

U.S. PATENT DOCUMENTS

2013/0181871 A1* 7/2013 Eom ..... H01Q 9/42 343/702
2014/0071005 A1* 3/2014 Wang ..... H01Q 21/28 343/725

(Continued)

FOREIGN PATENT DOCUMENTS

TW M553500 U 12/2017
TW I648908 B 1/2019

OTHER PUBLICATIONS

Chinese language office action dated Apr. 22, 2020, issued in application No. TW 108108755.

(Continued)

*Primary Examiner* — Thai Pham
(74) *Attorney, Agent, or Firm* — McClure, Qualey & Rodack, LLP

(57) ABSTRACT

A mobile device includes a metal mechanism element, a dielectric substrate, and a feeding radiation element. The metal mechanism element has an open slot. The open slot substantially has an L-shape. The dielectric substrate is adjacent to the metal mechanism element. The feeding radiation element has a feeding point. The feeding radiation element is disposed on the dielectric substrate. The feeding radiation element at least partially extends along the open slot. An antenna structure is formed by the feeding radiation element and the open slot of the metal mechanism element. The antenna structure covers a first frequency band, a second frequency band, and a third frequency band.

8 Claims, 7 Drawing Sheets

(51) Int. Cl.
*H01Q 1/22* (2006.01)
*H01Q 9/28* (2006.01)

(56) References Cited

U.S. PATENT DOCUMENTS

| | | | | |
|---|---|---|---|---|
| 2015/0029068 | A1* | 1/2015 | Toyao | H01Q 13/106 343/770 |
| 2017/0005414 | A1* | 1/2017 | Yang | H01Q 5/378 |
| 2017/0207542 | A1* | 7/2017 | Tseng | H01Q 13/106 |
| 2019/0027811 | A1* | 1/2019 | Chen | H04M 1/26 |

OTHER PUBLICATIONS

Chinese language office action dated Jan. 20, 2020, issued in application No. TW 108108755.

* cited by examiner

MOBILE DEVICE

CROSS REFERENCE TO RELATED APPLICATIONS

This application claims priority of Taiwan Patent Application No. 108108755 filed on Mar. 15, 2019, the entirety of which is incorporated by reference herein.

BACKGROUND OF THE INVENTION

Field of the Invention

The disclosure generally relates to a mobile device, and more particularly, it relates to a mobile device and an antenna element therein.

Description of the Related Art

With the advancements being made in mobile communication technology, mobile devices such as portable computers, mobile phones, multimedia players, and other hybrid functional portable electronic devices have become more common. To satisfy user demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, 2500 MHz, and 2700 MHz. Some devices cover a small wireless communication area; these include mobile phones using Wi-Fi and Bluetooth systems and using frequency bands of 2.4 GHz, 5.2 GHz, and 5.8 GHz.

In order to improve their appearance, current designers often incorporate metal elements into mobile devices. However, these newly added metal elements tend to negatively affect the antennas used for wireless communication in mobile devices, thereby degrading the overall communication quality of the mobile devices. As a result, there is a need to propose a novel mobile device with a novel antenna structure, so as to overcome the problems of the prior art.

BRIEF SUMMARY OF THE INVENTION

In an exemplary embodiment, the disclosure is directed to a mobile device which includes a metal mechanism element, a dielectric substrate, and a feeding radiation element. The metal mechanism element has an open slot. The open slot substantially has an L-shape. The dielectric substrate is adjacent to the metal mechanism element. The feeding radiation element has a feeding point. The feeding radiation element is disposed on the dielectric substrate. The feeding radiation element at least partially extends along the open slot. An antenna structure is formed by the feeding radiation element and the open slot of the metal mechanism element. The antenna structure covers a first frequency band, a second frequency band, and a third frequency band.

In some embodiments, the first frequency band is at 1575 MHz, the second frequency band is from 2400 MHz to 2500 MHz, and the third frequency band is from 5150 MHz to 5850 MHz.

In some embodiments, the opening slot includes a first portion and a second portion which are substantially perpendicular to each other. The first portion is adjacent to an open end of the open slot. The second portion is adjacent to a closed end of the open slot.

In some embodiments, the total length of the open slot is substantially equal to 0.25 wavelength of the first frequency band.

In some embodiments, the feeding radiation element substantially has an inverted U-shape.

In some embodiments, the feeding radiation element includes a first segment, a second segment, and a third segment. The feeding point is positioned on the first segment. The third segment is coupled through the second segment to the first segment.

In some embodiments, the second segment of the feeding radiation element extends along the first portion of the open slot, and the third segment of the feeding radiation element extends along the second portion of the open slot.

In some embodiments, the mobile device further includes a first widening element disposed on the dielectric substrate. The first widening element is coupled to the first segment of the feeding radiation element.

In some embodiments, the mobile device further includes a second widening element disposed on the dielectric substrate. The second widening element is coupled to the intersection point between the first segment and the second segment of the feeding radiation element.

In some embodiments, the mobile device further includes a third widening element disposed on the dielectric substrate. The third widening element is coupled to the third segment of the feeding radiation element.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are shown in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range.

One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

Figure 1A:
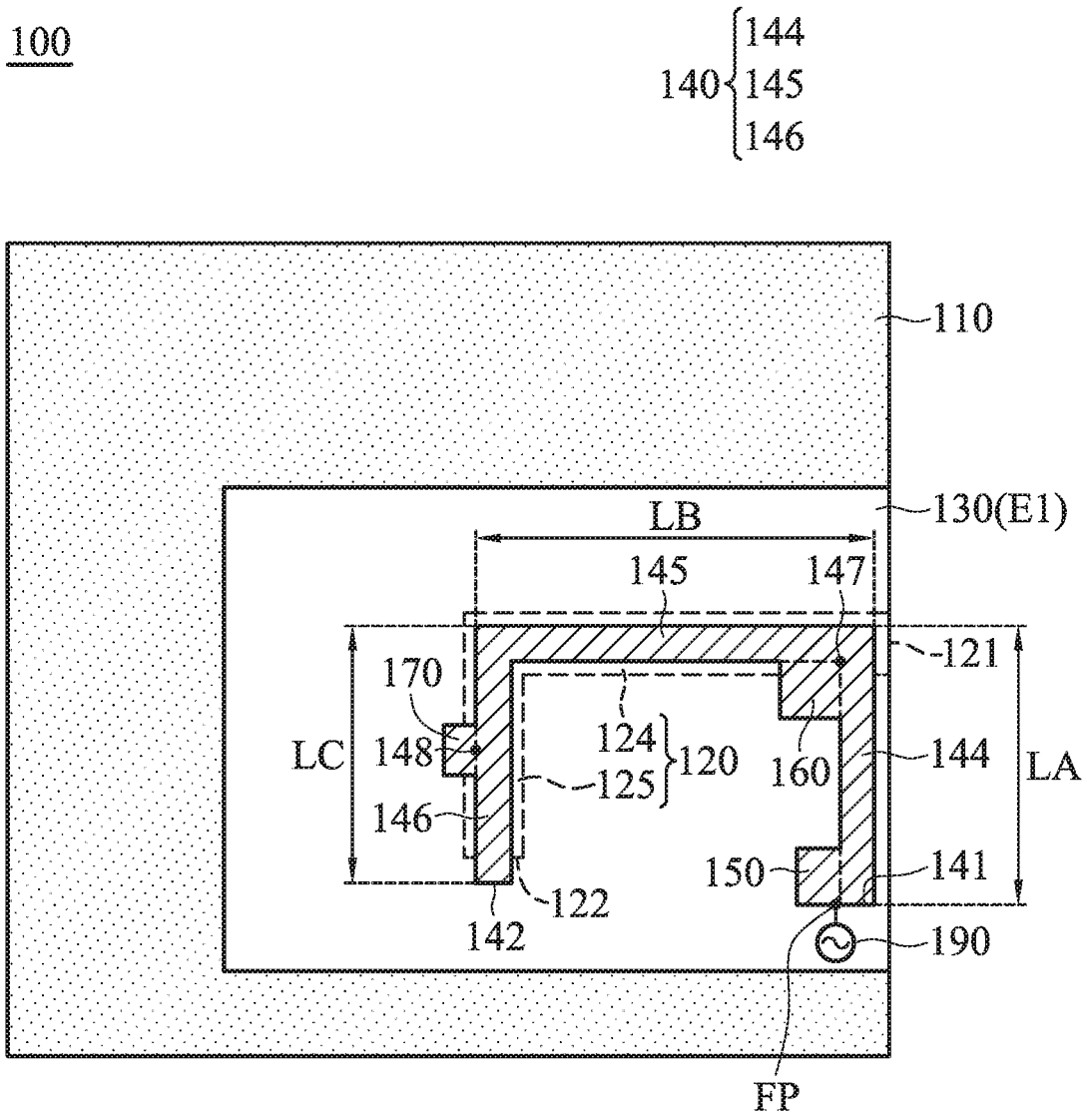
FIG. 1A is a top view of a mobile device according to an embodiment of the invention.
Figure 1B:
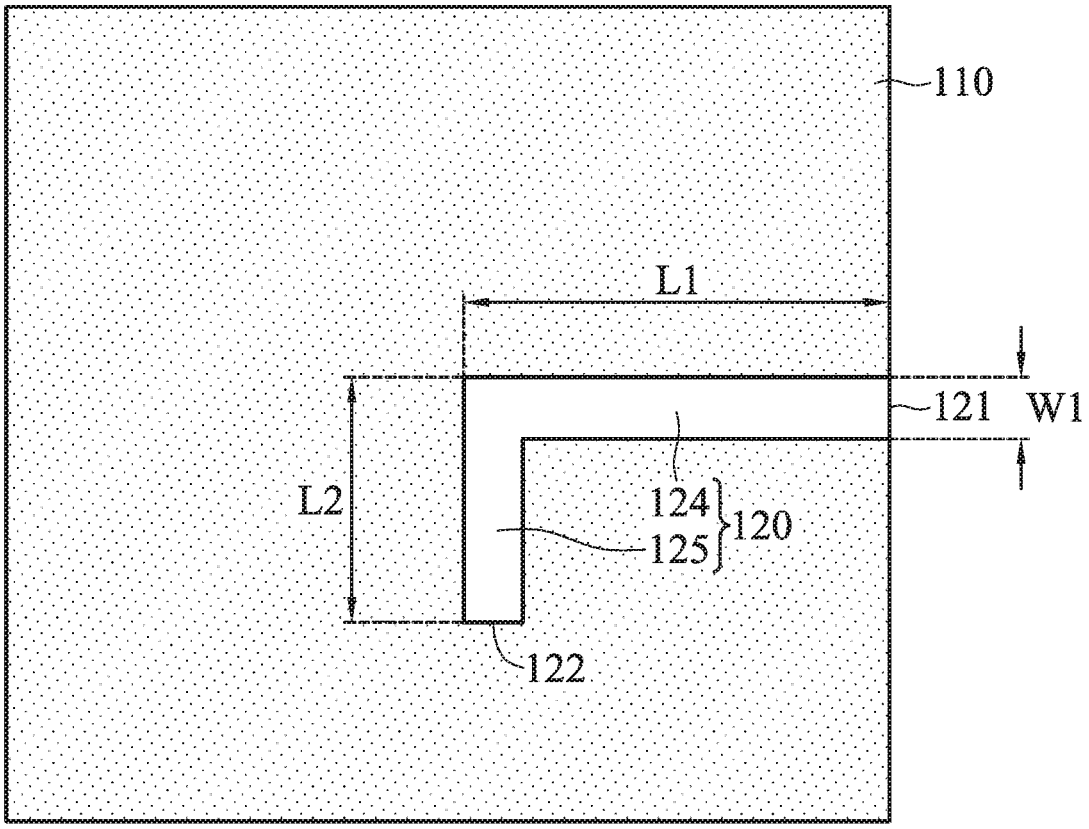
FIG. 1B is a top view of a metal mechanism element according to an embodiment of the invention.
Figure 1C:
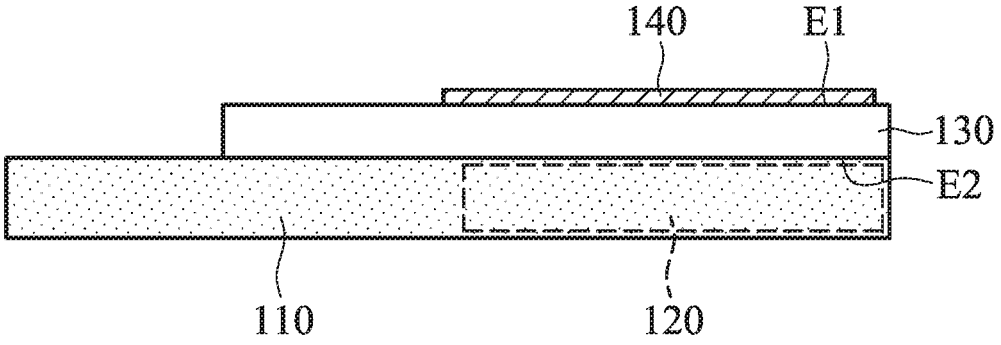
FIG. 1C is a side view of a mobile device according to an embodiment of the invention.

FIG. 1A is a top view of a mobile device 100 according to an embodiment of the invention. For example, the mobile device 100 may be a smartphone, a tablet computer, or a notebook computer. As shown in FIG. 1A, the mobile device 100 at least includes a metal mechanism element 110, a dielectric substrate 130, and a feeding radiation element 140. The feeding radiation element 140 may be made of a metal material, such as copper, silver, aluminum, iron, or their alloys. FIG. 1B is a top view of the metal mechanism element 110 according to an embodiment of the invention. FIG. 1C is a side view of the mobile device 100 according to an embodiment of the invention. Please refer to FIG. 1A, FIG. 1B and FIG. 1C together. It should be understood that the mobile device 100 may further include a touch control panel, a display device, a speaker, a battery module and/or a housing although they are not displayed in FIG. 1A, FIG. 1B and FIG. 1C.

The metal mechanism element 110 may be a metal housing of the mobile device 100. In some embodiments, the metal mechanism element 110 is a metal upper cover of a notebook computer or a metal back cover of a tablet computer, but it is not limited thereto. For example, if the mobile device 100 is a notebook computer, the metal mechanism element 110 may be the so-called "A-component" in the field of notebook computers. The metal mechanism element 110 has an open slot 120. The open slot 120 of the metal mechanism element 110 may substantially have an L-shape. The open slot 120 has an open end 121 and a closed end 122 which are far away from each other. Specifically, the open slot 120 includes a first portion 124 and a second portion 125. Each of the first portion 124 and the second portion 125 may substantially have a straight-line shape. The first portion 124 and the second portion 125 may be substantially perpendicular to each other. The first portion 124 of the open slot 120 is adjacent to the open end 121 of the open slot 120. The second portion 125 of the open slot 120 is adjacent to the closed end 122 of the open slot 120. The length L1 of the first portion 124 of the open slot 120 may be longer than or equal to the length L2 of the second portion 125 of the open slot 120. In some embodiments, the mobile device 100 further includes a nonconductive filling element (not shown), which fills the open slot 120 of the metal mechanism element 110, so as to provide the functions of waterproofing or dustproofing.

The dielectric substrate 130 may be an FR4 (Flame Retardant 4) substrate, a PCB (Printed Circuit Board), or an FCB (Flexible Circuit Board). The dielectric substrate 130 has a first surface E1 and a second surface E2 which are opposite to each other. The feeding radiation element 140 is disposed on the first surface E1 of the dielectric substrate 130. The second surface E2 of the dielectric substrate 130 is adjacent to the open slot 120 of the metal mechanism element 110. It should be noted that the term "adjacent" or "close" over the disclosure means that the distance (spacing) between two corresponding elements is smaller than a predetermined distance (e.g., 5 mm or shorter), or it means that the two corresponding elements are touching each other directly (i.e., the aforementioned distance/spacing therebetween is reduced to 0). In some embodiments, the second surface E2 of the dielectric substrate 130 is directly attached to the metal mechanism element 110, and the dielectric substrate 130 extends across the open slot 120 of the metal mechanism element 110. In a preferred embodiment, an antenna structure is formed by the feeding radiation element 140 and the slot 120 of the metal mechanism element 110.

The feeding radiation element 140 may substantially have an inverted U-shape. The feeding radiation element 140 has a first end 141 and a second end 142. A feeding point FP is positioned at the first end 141 of the feeding radiation element 140. The second end 142 of the feeding radiation element 140 is an open end. The feeding point FP may be coupled to a signal source 190. For example, the signal source 190 may be an RF (Radio Frequency) module for exciting the antenna structure of the mobile device 100. The feeding radiation element 140 at least partially extends along the open slot 120. That is, the feeding radiation element 140 has a whole vertical projection on the metal mechanism element 110, and the whole vertical projection at least partially overlaps the open slot 120.

Specifically, the feeding radiation element 140 includes a first segment 144, a second segment 145, and a third segment 146. The feeding point FP is positioned on the first segment 144. The third segment 146 is coupled through the second segment 145 to the first segment 144. Each of the first segment 144, the second segment 145, and the third segment 146 may substantially have a straight-line shape. The first segment 144 and the third segment 146 may be substantially parallel to each other. The second segment 145 may be substantially perpendicular to both the first segment 144 and the third segment 146. The length LB of the second segment 145 may be longer than or equal to the length LA of the first segment 144. The length LA of the first segment 144 may be longer than or equal to the length LC of the third segment 146. The second segment 145 of the feeding radiation element 140 extends along the first portion 124 of the open slot 120. That is, the second segment 145 of the feeding radiation element 140 has a first vertical projection on the metal mechanism element 110, and the first vertical projection is completely or at least partially inside the first portion 124 of the open slot 120. The third segment 146 of the feeding radiation element 140 extends along the second portion 125 of the open slot 120. That is, the third segment 146 of the feeding radiation element 140 has a second vertical projection on the metal mechanism element 110, and the second vertical projection is completely or at least partially inside the second portion 125 of the open slot 120. With such a design, the feeding radiation element 140 does not occupy additional design space so much, and it can effectively minimize the total antenna size of the mobile device 100.

In some embodiments, the mobile device 100 further includes one or more of a first widening element 150, a second widening element 160, and a third widening element 170, such that the feeding radiation element 140 has a variable-width structure. The first widening element 150, the second widening element 160, and the third widening element 170 are all made of metal materials, and they are all disposed on the first surface E1 of the dielectric substrate 130. Each of the first widening element 150, the second widening element 160, and the third widening element 170 may substantially have a rectangular shape or a square shape. The first widening element 150 is coupled to the first segment 144 of the feeding radiation element 140. The first widening element 150 is adjacent to the first end 141 and the feeding point FP of the feeding radiation element 140. The second widening element 160 is coupled to an intersection point 147 between the first segment 144 and the second segment 145 of the feeding radiation element 140. The third widening element 170 is coupled to a central point 148 of the third segment 146 of the feeding radiation element 140. It should be noted that the first widening element 150, the second widening element 160, and the third widening element 170 are optional elements, and they are omitted in other embodiments.

Figure 2:
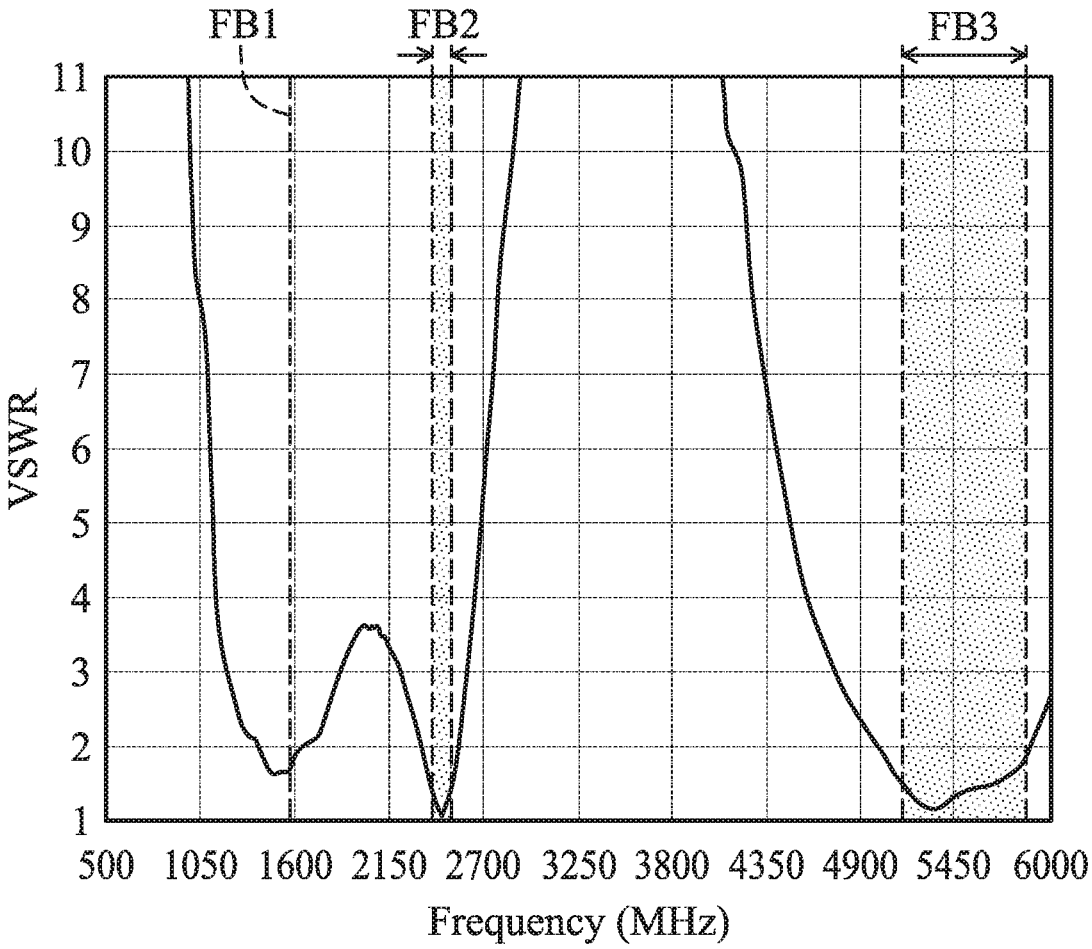
FIG. 2 is a diagram of VSWR (Voltage Standing Wave Ratio) of an antenna structure of a mobile device according to an embodiment of the invention.

FIG. 2 is a diagram of VSWR (Voltage Standing Wave Ratio) of the antenna structure of the mobile device 100 according to an embodiment of the invention. According to the measurement of FIG. 2, the antenna structure of the mobile device 100 can cover a first frequency band FB1, a second frequency band FB2, and a third frequency band FB3. The first frequency band FB1 may be substantially at 1575 MHz. The second frequency band FB2 may be substantially from 2400 MHz to 2500 MHz. The third frequency band FB3 may be substantially from 5150 MHz to 5850 MHz. Therefore, the antenna structure of the mobile device 100 can support at least the multiband operations of GPS (Global Positioning System) and WLAN (Wireless Local Area Networks) 2.4 GHz/5 GHz.

In some embodiments, the operation principles of the antenna structure of the mobile device 100 are described as follows. The feeding radiation element 140 and the open slot 120 of the metal mechanism element 110 are excited to generate the first frequency band FM, the second frequency band FB2, and the third frequency band FB3. Specifically, the whole open slot 120 corresponds to the first frequency band FM, the first portion 124 of the open slot 120 corresponds to the second frequency band FB2, and the second portion 125 of the open slot 120 corresponds to the third frequency band FB3. Furthermore, the whole feeding radiation element 140 contributes to the first frequency band FB1, and it also contributes to the third frequency band FB3 because of triple-frequency effect, so as to increase the bandwidths of both the first frequency band FB1 and the third frequency band FB3. The incorporation of the first widening element 150 can fine-tune the impedance matching of the third frequency band FB3. The incorporation of the second widening element 160 can separate the resonant mode of the first frequency band FB1 from the resonant mode of the second frequency band FB2. The incorporation of the third widening element 170 can fine-tune the impedance matching of the second frequency band FB2.

In some embodiments, the element sizes of the mobile device 100 are described as follows. The total length (i.e., L1+L2) of the open slot 120 may be substantially equal to 0.25 wavelength ($\lambda/4$) of the first frequency band FB1. The length L1 of the first portion 124 of the open slot 120 may be substantially equal to 0.25 wavelength ($\lambda/4$) of the second frequency band FB2. The length L2 of the second portion 125 of the open slot 120 may be substantially equal to 0.25 wavelength ($\lambda/4$) of the third frequency band FB3. The width W1 of the open slot 120 may be from 2 mm to 4 mm. The length LB of the second segment 145 of the feeding radiation element 140 may be shorter than or equal to the length L1 of the first portion 124 of the open slot 120. The length LC of the third segment 146 of the feeding radiation element 140 may be slightly longer, equal to, or shorter than the length L2 of the second portion 125 of the open slot 120. The thickness of the dielectric substrate 130 (i.e., the distance between the first surface E1 and the second surface E2) may be smaller than 1 mm, such as 0.4 mm. The antenna structure of the mobile device 100 may have a total length of about 19 mm and a total width of about 21 mm. The above ranges of element sizes are calculated and obtained according to many experiment results, and they help to optimize the operation bandwidth and impedance matching of the antenna structure of the mobile device 100.

Figure 3:
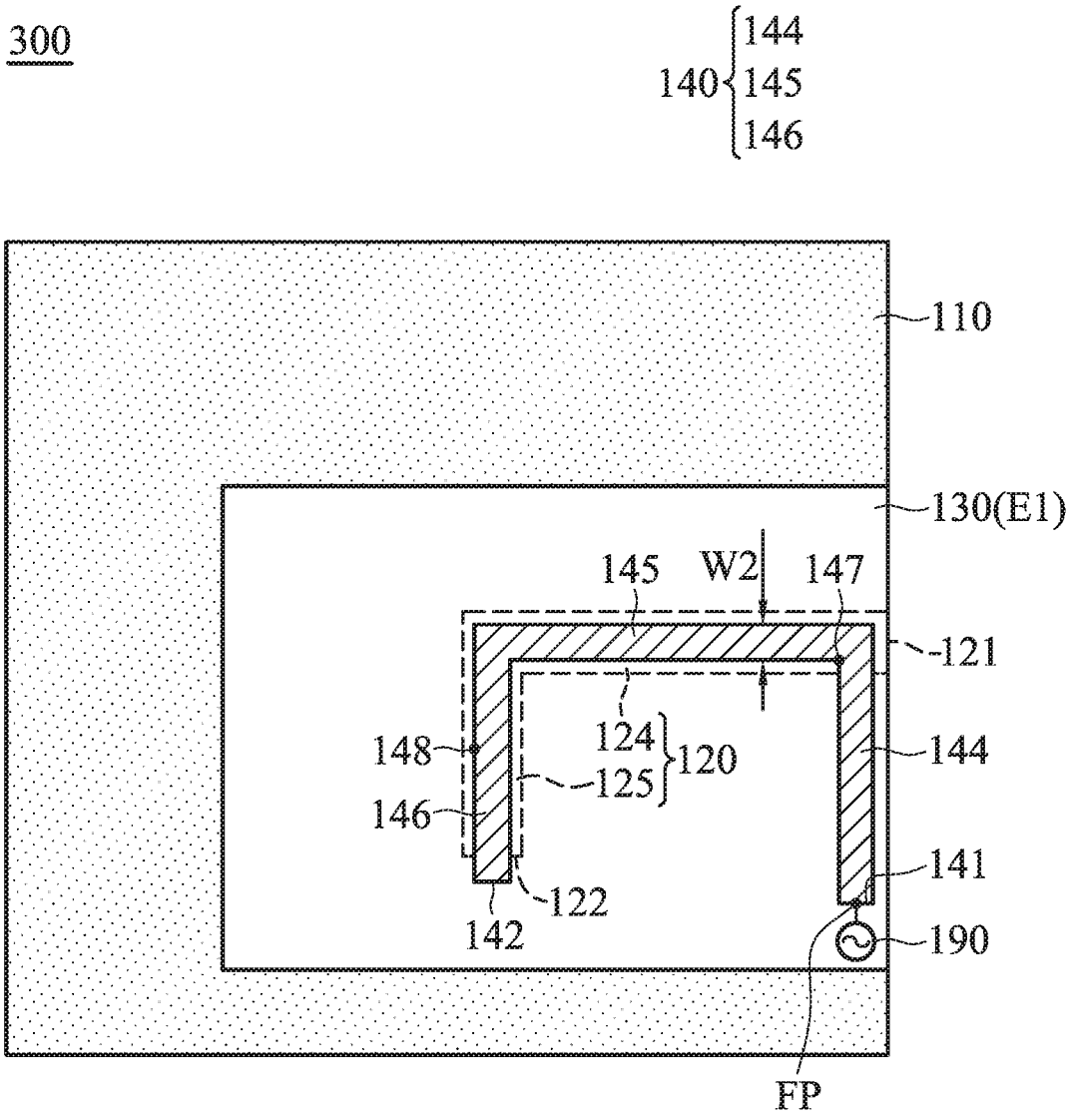
FIG. 3 is a top view of a mobile device according to another embodiment of the invention.

FIG. 3 is a top view of a mobile device 300 according to another embodiment of the invention. FIG. 3 is similar to FIG. 1A. In the embodiment of FIG. 3, the mobile device 300 does not include the first widening element 150, the second widening element 160, and the third widening element 170, such that the feeding radiation element 140 has an equal-width structure. For example, the width W2 of the feeding radiation element 140 may be from 2 mm to 4 mm, but it is not limited thereto. According to practical measurements, with an appropriate design of element sizes, the antenna structure of the mobile device 300 can also cover the first frequency band FB1, the second frequency band FB2, and the third frequency band FB3 as described above even if the first widening element 150, the second widening element 160, and the third widening element 170 are all omitted. Other features of the mobile device 300 of FIG. 3 are similar to those of the mobile device 100 of FIG. 1A, FIG. 1B, and FIG. 1C. Therefore, the two embodiments can achieve similar levels of performance.

Figure 4A:
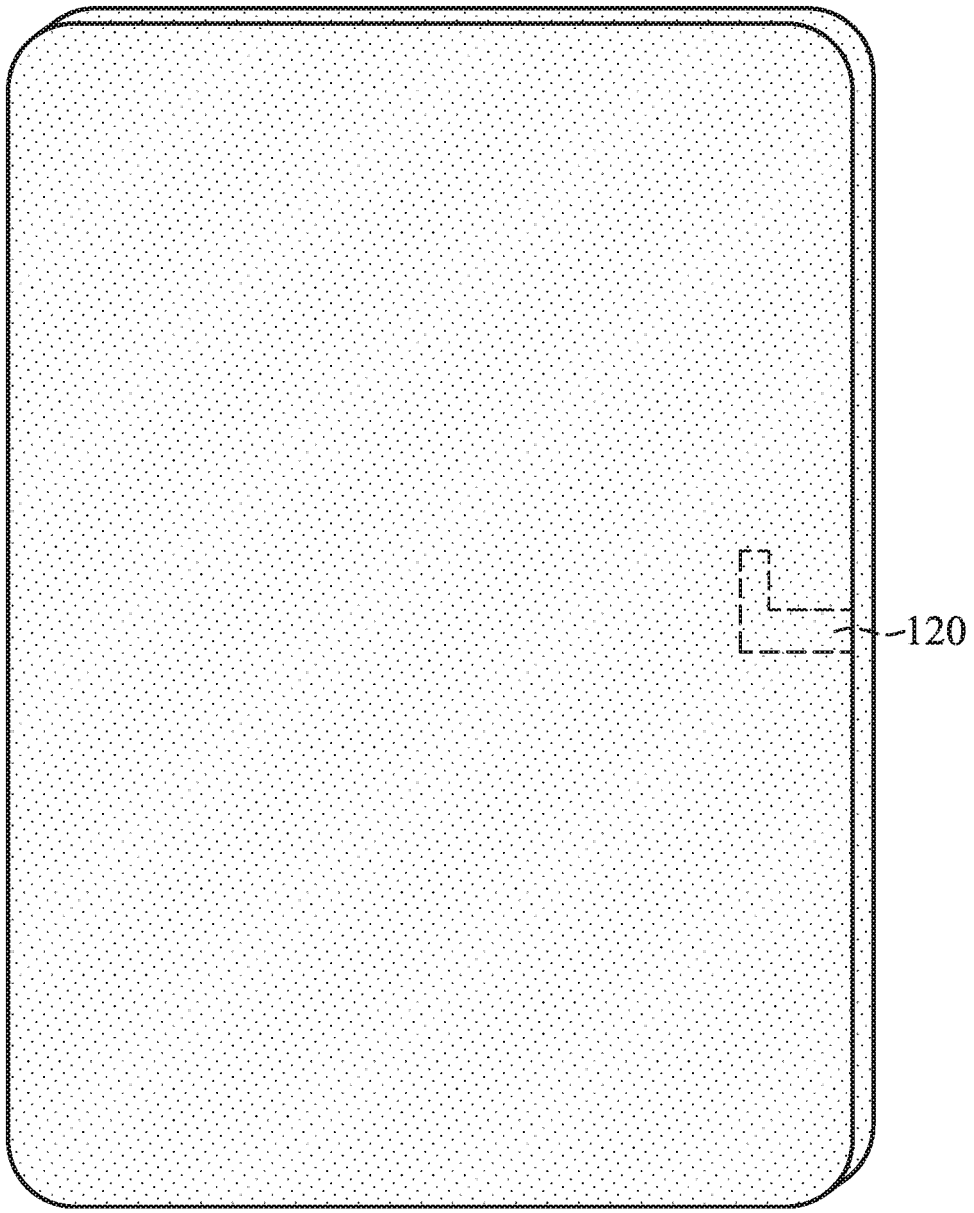
FIG. 4A is a perspective view of a mobile device according to another embodiment of the invention.

FIG. 4A is a perspective view of a mobile device 410 according to another embodiment of the invention. In the embodiment of FIG. 4A, the mobile device 410 is a tablet computer, and the aforementioned antenna structure (including the open slot 120) is formed at any position on the periphery of a metal back cover or a metal decorative board of the tablet computer. Other features of the mobile device 410 of FIG. 4A are similar to those of the mobile device 100 of FIG. 1A, FIG. 1B, and FIG. 1C. Therefore, the two embodiments can achieve similar levels of performance.

Figure 4B:
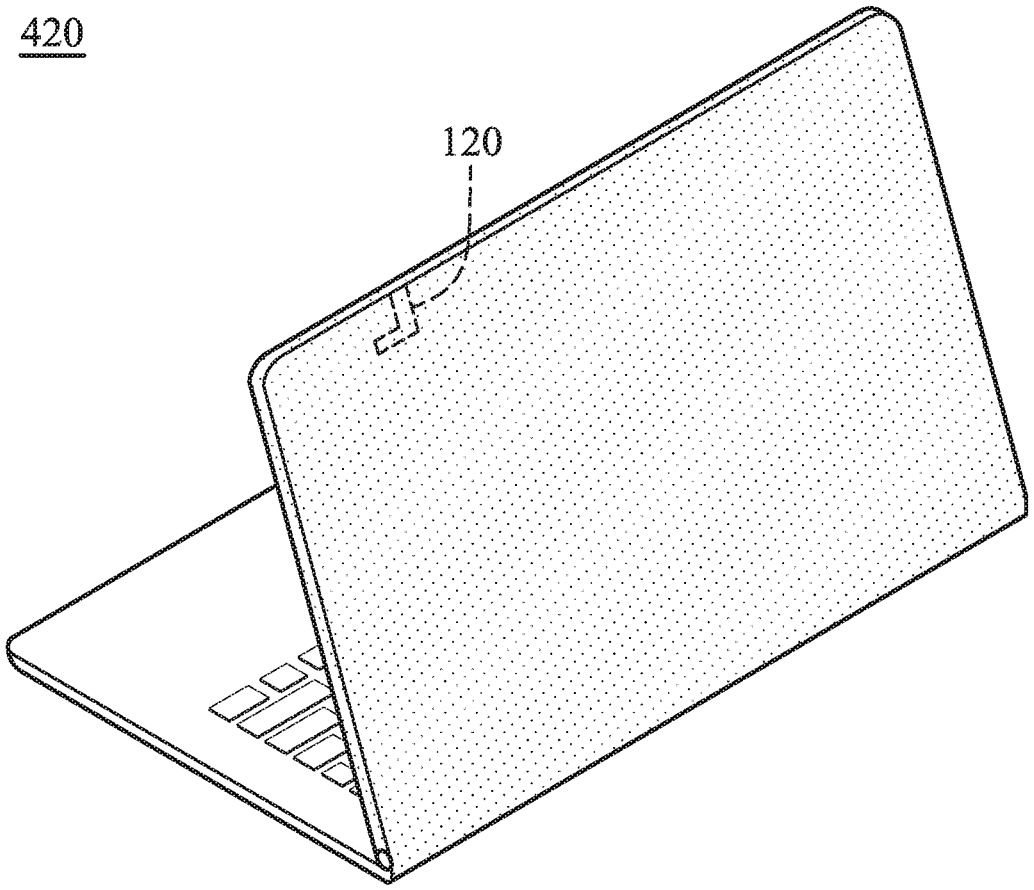
FIG. 4B is a perspective view of a mobile device according to another embodiment of the invention.

FIG. 4B is a perspective view of a mobile device 420 according to another embodiment of the invention. In the embodiment of FIG. 4B, the mobile device 420 is a notebook computer, and the aforementioned antenna structure (including the open slot 120) is formed at any position on the periphery of a metal upper cover or a metal decorative board of the notebook computer. Other features of the mobile device 420 of FIG. 4B are similar to those of the mobile device 100 of FIG. 1A, FIG. 1B, and FIG. 1C. Therefore, the two embodiments can achieve similar levels of performance.

Figure 4C:
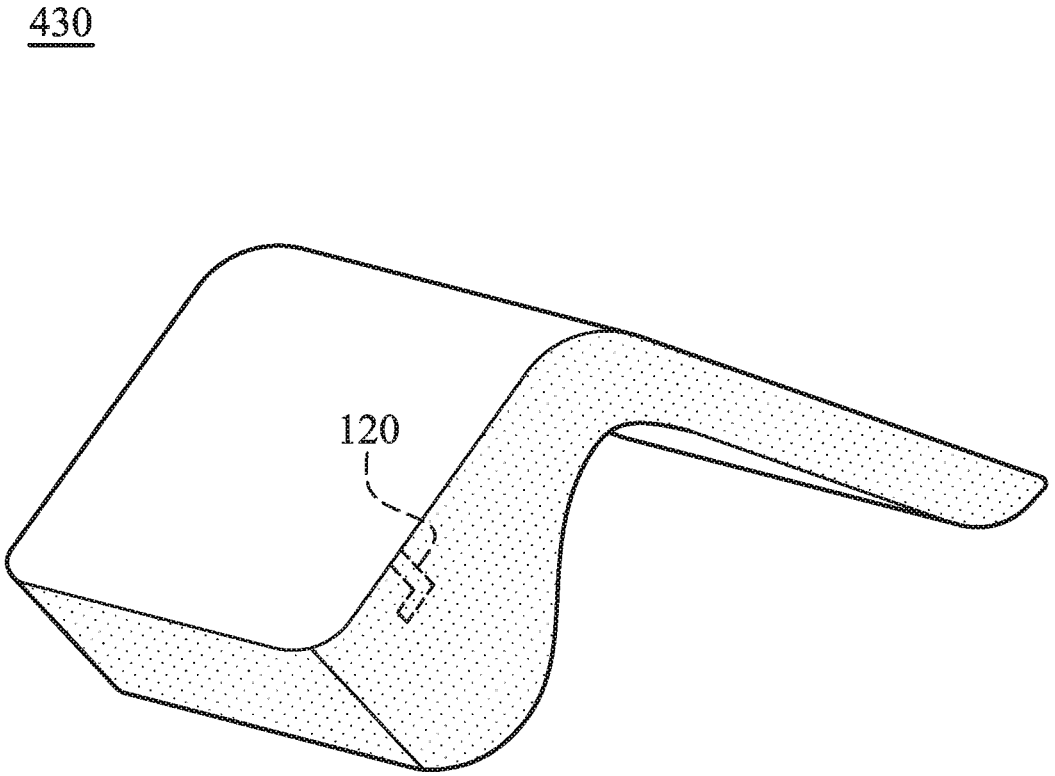
FIG. 4C is a perspective view of a mobile device according to another embodiment of the invention.

FIG. 4C is a perspective view of a mobile device 430 according to another embodiment of the invention. In the embodiment of FIG. 4C, the mobile device 430 is a POS (Point of Sales) system, and the aforementioned antenna structure (including the open slot 120) is formed at any position on a metal housing of the POS system. Other features of the mobile device 430 of FIG. 4C are similar to those of the mobile device 100 of FIG. 1A, FIG. 1B, and FIG. 1C. Therefore, the two embodiments can achieve similar levels of performance.

The invention proposes a novel mobile device and a novel antenna structure, which are integrated with a metal mechanism element. The metal mechanism element does not negatively affect the radiation performance of the antenna structure because the metal mechanism element is considered as an extension portion of the antenna structure. Furthermore, such a design can minimize the total antenna size since the feeding radiation element of the antenna structure at least partially extends along the open slot of the metal mechanism element. In comparison to the conventional design, the invention has at least the advantages of small size, wide bandwidth, and beautiful device appearance, and therefore it is suitable for application in a variety of mobile communication devices.

Note that the above element sizes, element shapes, and frequency ranges are not limitations of the invention. An antenna designer can fine-tune these settings or values according to different requirements. It should be understood that the mobile device and antenna structure of the invention are not limited to the configurations of FIGS. 1-4. The invention may merely include any one or more features of any one or more embodiments of FIGS. 1-4. In other words, not all of the features displayed in the figures should be implemented in the mobile device and antenna structure of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A mobile device, comprising:

a metal mechanism element, having an open slot, wherein the open slot substantially has an L-shape;

a dielectric substrate, disposed adjacent to the metal mechanism element; and a feeding radiation element, having a feeding point, and disposed on the dielectric substrate, wherein the feeding radiation element at least partially extends along the open slot;

wherein an antenna structure is formed by the feeding radiation element and the open slot of the metal mechanism element;

wherein the antenna structure covers a first frequency band, a second frequency band, and a third frequency band;

wherein the first frequency band is at 1575 MHz, the second frequency band is from 2400 MHz to 2500 MHz, and the third frequency band is from 5150 MHz to 5850 MHz;

wherein the opening slot comprises a first portion and a second portion which are substantially perpendicular to each other, wherein the first portion is adjacent to an open end of the open slot, and wherein the second portion is adjacent to a closed end of the open slot;

wherein a length of the first portion of the open slot is substantially equal to 0.25 wavelength of the second frequency band, and a length of the second portion of the open slot is substantially equal to 0.25 wavelength of the third frequency band.

2. The mobile device as claimed in claim 1, wherein a total length of the open slot is substantially equal to 0.25 wavelength of the first frequency band.

3. The mobile device as claimed in claim 1, wherein the feeding radiation element substantially has an inverted U-shape.

4. The mobile device as claimed in claim 1, wherein the feeding radiation element comprises a first segment, a second segment, and a third segment, wherein the feeding point is positioned on the first segment, and wherein the third segment is coupled through the second segment to the first segment.

5. The mobile device as claimed in claim 4, wherein the second segment of the feeding radiation element extends along the first portion of the open slot, and wherein the third segment of the feeding radiation element extends along the second portion of the open slot.

6. The mobile device as claimed in claim 4, further comprising:

a first widening element, disposed on the dielectric substrate, and coupled to the first segment of the feeding radiation element.

7. The mobile device as claimed in claim 4, further comprising:

a second widening element, disposed on the dielectric substrate, and coupled to an intersection point between the first segment and the second segment of the feeding radiation element.

8. The mobile device as claimed in claim 4, further comprising:

a third widening element, disposed on the dielectric substrate, and coupled to the third segment of the feeding radiation element.

* * * * *